US010418140B2

(12) United States Patent
Yamagata et al.

(10) Patent No.: US 10,418,140 B2
(45) Date of Patent: Sep. 17, 2019

(54) NEUTRON SOURCE AND NEUTRON GENERATOR

(71) Applicant: RIKEN, Saitama (JP)

(72) Inventors: Yutaka Yamagata, Saitama (JP); Jungmyoung Ju, Saitama (JP); Katsuya Hirota, Saitama (JP)

(73) Assignee: RIKEN, Saitama (JP)

( * ) Notice: Subject to any disclaimer, the term of this patent is extended or adjusted under 35 U.S.C. 154(b) by 334 days.

(21) Appl. No.: 14/382,132

(22) PCT Filed: Mar. 6, 2013

(86) PCT No.: PCT/JP2013/056188

§ 371 (c)(1),
(2) Date: Dec. 2, 2014

(87) PCT Pub. No.: WO2013/133342

PCT Pub. Date: Sep. 12, 2013

(65) Prior Publication Data

US 2015/0117584 A1 Apr. 30, 2015

(30) Foreign Application Priority Data

Mar. 6, 2012 (JP) ..... 2012-049614

(51) Int. Cl.

| | |
|---|---|
| ***G21G 4/02*** | (2006.01) |
| ***H05H 3/06*** | (2006.01) |
| ***H05H 6/00*** | (2006.01) |

(52) U.S. Cl.

CPC ..... *G21G 4/02* (2013.01); *H05H 3/06* (2013.01); *H05H 6/00* (2013.01)

(58) Field of Classification Search

CPC ..... A61K 51/1282; H05H 3/06; H05H 6/00; G21G 4/08; G21G 1/06; G21G 1/001;
(Continued)

(56) References Cited

U.S. PATENT DOCUMENTS 3,500,098 A * 3/1970 Fraser ..... H05H 6/00 376/194
3,508,058 A * 4/1970 Frentrop ..... G01V 5/00 376/108

(Continued)

FOREIGN PATENT DOCUMENTS

| | | |
|---|---|---|
| DE | 1564582 | 7/1969 |
| JP | 55-53899 | 4/1980 |

(Continued)

OTHER PUBLICATIONS

Bayanov et al., "Lithium neutron producing target for BINP accelerator-based neutron source." (Year: 2004).*

(Continued)

*Primary Examiner* — Peter M Poon
*Assistant Examiner* — Daniel Wasil
(74) *Attorney, Agent, or Firm* — Casimir Jones, SC; Robert A. Goetz

(57) ABSTRACT

The present invention provides a novel neutron source. A neutron source (1) of the present invention includes a neutron producing material layer (3) and a metal layer (2), and the metal layer (2) contains a metal element which has a high hydrogen diffusivity and generates radionuclides having a short half-life upon receipt of irradiation of neutron beams.

6 Claims, 7 Drawing Sheets

(58) Field of Classification Search
CPC .. G21G 4/02; G21G 1/04; G21G 4/06; G21G 1/0005; G21G 1/00; G21G 2001/0036; G21G 2001/0042; G21G 1/08; G21G 2001/0094; G21G 2001/0015
USPC ..... 376/114, 115
See application file for complete search history.

(56) References Cited

U.S. PATENT DOCUMENTS

| | | | | |
|---|---|---|---|---|
| 4,298,804 | A | 11/1981 | Colditz | |
| 4,935,194 | A | 6/1990 | Verschoore | |
| 5,870,447 | A * | 2/1999 | Powell | G21G 1/10 376/190 |
| 2009/0162278 | A1* | 6/2009 | Ravn | G21G 1/001 424/1.37 |
| 2010/0067640 | A1* | 3/2010 | Willis | H05H 3/06 376/194 |
| 2010/0215137 | A1* | 8/2010 | Nagai | G21G 1/06 376/158 |
| 2011/0044418 | A1* | 2/2011 | Stubbers | H05H 3/06 376/116 |
| 2011/0091000 | A1* | 4/2011 | Stubbers | H05H 3/06 376/109 |
| 2011/0235766 | A1* | 9/2011 | Stora | G21G 1/10 376/151 |
| 2011/0268237 | A1* | 11/2011 | Holden | G21G 1/10 376/108 |

FOREIGN PATENT DOCUMENTS

| | | |
|---|---|---|
| JP | 1-312500 | 12/1989 |
| JP | 2000-162399 | 6/2000 |
| JP | 2003-303700 | 10/2003 |
| JP | 2009-47432 | 3/2009 |
| JP | 2010-223942 | 10/2010 |
| WO | 2010/034364 | 4/2010 |

OTHER PUBLICATIONS

Polosatkin, S.V., "Experimental Studies of Blistering of Targets Irradiated by Intense 200 keV Proton Beam," Proceedings of the 9th Confrence on Modification of Materials with Particle Beams and Plasma Flows, Sep. 21-26, 2008, pp. 131-134.

Ju, Jungmyoung, et al., "Simulation and design of beryllium target combined with hydrogen diffusible metal for compact neutron source in RIKEN," date unknown, PS2-074, p. 359, Abstract of 1st Asia-Oceania Conference on Neutron.

Willis,, Carl, et al., "High-Power Lithium Target for Accelerator-Based BNCT," Proceedings of the XXIV Linear Acelerator Conference, pp. 223-225 (2008).

Aleynik, V., et al., "BINP accelerator based epithermal neutron source," Applied Radiation and Isotopes, vol. 69, pp. 1635-1638 (2011).

Bayanov, B., et al., "A neutron producing target for BINP accelerator-based neutron source," Applied Radiation and Isotopes, vol. 67, Issues 7-8, Supplement, pp. S282-S284 (2009).

Bayanov, B., et al., "Neutron producing target for accelerator based neutron capture therapy," Journal of Physics Conference Series 41, pp. 460-465, 2006, Institute of Physics Publishing.

International Preliminary Report on Patentability of PCT/JP2013/056188, dated Sep. 12, 2014.

Internatioanl Search Report for PCT/JP2013/056188, dated Jun. 11, 2013.

Office Action, Corresponding to JP Application No. 2014-503524 dated Dec. 15, 2015.

Explanation of Circumstances Concerning Accelerated Examination for JP 2014-503524.

Documents for response to European Patent Search Report for EP Application No. 13757266.5.

European Search Report ,Corresponding to EP Application No. 13757266.5 dated Jul. 7, 2015.

Yamagata, Yutaka "Development of a neutron generating target for compact neutron sources using low energy proton beams" J Radioanalytical and Nucl Chem, Sep. 2015, vol. 305, Issue 3, pp. 787-794.

* cited by examiner (a)

(b)

Stopping power calculated by PSTAR [National Institute of Standards and Technology], and required thickness of Be target (a)

(b)

H ion concentration : mol/m$^3$

Concentration of H ion calculated by COLSOL multiphysics

NEUTRON SOURCE AND NEUTRON GENERATOR

CROSS REFERENCE TO RELATED APPLICATIONS

The present application is a Section 371 U.S. national stage entry of pending International Patent Application No. PCT/JP2013/056188, International Filing Date Mar. 6, 2013, which published on Sep. 12, 2013 as Publication No. WO 2013/133342, which claims the benefit of Japanese Patent Application No. 2012-049614, filed Mar. 6, 2012, the contents of which are incorporated by reference in their entireties.

TECHNICAL FIELD

The present invention relates to a neutron source and a neutron generator including the same.

BACKGROUND ART

In recent years, instead of a method of producing neutron beams with high energy efficiency as used in a large facility, there has been tried to be developed a method of producing neutron beams with use of low energy beams. In such a method, neutron beams are produced by, for example, irradiating a target (e.g., Be, Li, or the like) with proton beams to thereby cause a nuclear reaction. This method can produce neutron beams with use of extremely low energy proton beams.

According to the above method, for example, there is no need to provide a gigantic radiation blocking structure which can be accepted only in a large facility. It is therefore considered that a neutron source employing the above method is extremely suitable for use in a small facility. In particular, in a case where proton beams having an energy of not more than 13 MeV are used, the neutron source can be easily handled because an amount of a resultant radioactivated material is extremely low.

However, low energy proton beams penetrate a target extremely shallowly. Therefore, a proton, with which a material is irradiated becomes hydrogen and the hydrogen is easily accumulated in the target locally. In view of this, it is known that a target is broken mainly by a mechanism of hydrogen embrittlement for an extremely short time. This phenomenon is called blistering. From a practical standpoint, the blistering is a fatal problem in a low energy neutron generator employing the above method.

In view of this problem, various researches have been conducted. There is reported a neutron source for producing neutron with use of a Li (p, n) reaction in which Li is used (Non-patent Literatures 1-4).

In Non-patent Literatures 1 through 3, blistering of a Li target was verified. Specifically, Non-patent Literatures 1 through 3 report that, in a case where a Li target is irradiated with proton beams of 2.5 MeV or 1.9 MeV, blistering occurs due to a beam current having 10 mA after 3.5 hours from this irradiation. Those literatures conclude that the blistering is not problematic from a practical standpoint, because a single irradiation time period in a BNCT therapy (Boron Neutron Capture Therapy) is shorter than the above time period.

Non-patent Literature 4 reports a structure for preventing hydrogen embrittlement of a target. According to the report, protons (hydrogen atoms) which have passed through Li are absorbed and diffused by the structure in which a thin film made from Pd having high hydrogen transparency is formed under Li.

Non-patent Literature 5 shows a result of simulation for preventing hydrogen embrittlement with use of a target other than Li. From the simulation, such a result was obtained that, when a neutron source is formed by joining thin Be and Nb, hydrogen embrittlement is preventable because almost all irradiated proton beams penetrate Be and are remained in Nb. Therefore, there is a possibility that the structure stably prevents hydrogen embrittlement of a neutron source for a long time.

Non-patent Literature 6 reports results of tests regarding conditions for causing blistering in various metals when the various metals are irradiated with proton beams. The test is carried out by observing the metals which have been irradiated with proton beams of 200 keV with use of, for example, an electron microscope by an optical method. As the result of this, it is reported that blistering does not occur in V and Ta under the tested conditions.

CITATION LIST

Non-Patent Literatures

Non-Patent Literature 1

B. Bayanov et. al., Neutron producing target for accelerator based neutron capture therapy, Journal of Physics Conference Series 41 pp. 460-465, 2006 Institute of Physics Publishing Non-Patent Literature 2

B. Bayanov et. al., A neutron producing target for BINP accelerator-based neutron source, Applied Radiation and Isotopes, Volume 67, Issues 7-8, Supplement, Pages S282-S284, 2009

Non-Patent Literature 3

V. Aleynik et. al., BINPacceleratorbasedepithermalneutronsource, Applied Radiation and Isotopes vol. 69, pp. 1635-1638, 2011

Non-Patent Literature 4

C. Willis et. al., High-power lithium target for accelerator-based BNCT, Proceedings of the XXIV Linear Accelerator Conference, pp. 223-225, 2008

Non-Patent Literature 5

J. Ju et. al., Simulation and design of beryllium target combined with hydrogen diffusible metal for compact neutron source in RIKEN, PS2-074, p. 359, Abstract of 1st Asia-Oceania Conference on Neutron Scattering, 2011

Non-Patent Literature 6

S. V. Polosatkin et. al., Experimental Studies of Blistering of Targets Irradiated by Intense 200 keV Proton Beam, Proceedings of the 9th Conference on Modification of Materials with Particle Beams and Plasma Flows, September 21-26, pp. 131-134, 2008

SUMMARY OF INVENTION

Technical Problem

For example, in the techniques of Non-patent Literatures 1 through 3, blistering in a target occurs after a neutron source is continuously operated for a long time (e.g., more than 3.5 hours). Therefore, the techniques of Non-patent Literatures 1 through 3 can be employed only when the neutron source needs to be operated only for a short time to achieve an object of such operation. In a technique of Non-patent Literature 4, because a Pd film is not thick enough, there is a possibility that hydrogen embrittlement caused by proton beams is not perfectly prevented. In a technique of Non-patent Literature 5, it may be possible to achieve a practical small neutron source, however, it is merely a possibility. In a technique of Non-patent Literature 6, a property of a material of a plasma facing component (FPC) such as a diverter is only inspected. Specifically, the material is tested only under a condition of less than a threshold energy (2 MeV) for neutron generation, and therefore the technique cannot be used for a target in a neutron source.

As described above, various improvements are needed to put to practical use a small neutron source and a neutron generator including the same.

The present invention has been made in view of the above problems, and an object of the present invention is to provide a novel and small neutron source.

Solution to Problem

In order to achieve the object, a neutron source of the present invention includes: a neutron producing material layer for producing neutron beams upon receipt of irradiation of proton beams; and a metal layer joined with the neutron producing material layer, the metal layer containing, as a main content, such a metal element that has the metal layer having a hydrogen diffusion coefficient of not less than $10^{-11}$ at 60° C., and generates radionuclides upon receipt of the irradiation of the neutron beams, among which radionuclides, a type of radionuclides having a largest total radiation dose has a half-life of not more than 12 hours.

In order to achieve the object, a neutron generator of the present invention includes the neutron source.

Advantageous Effects of Invention

As described above, according to the present invention, it is possible to provide a small neutron source which satisfies a requirement for practical use.

Figure 2:
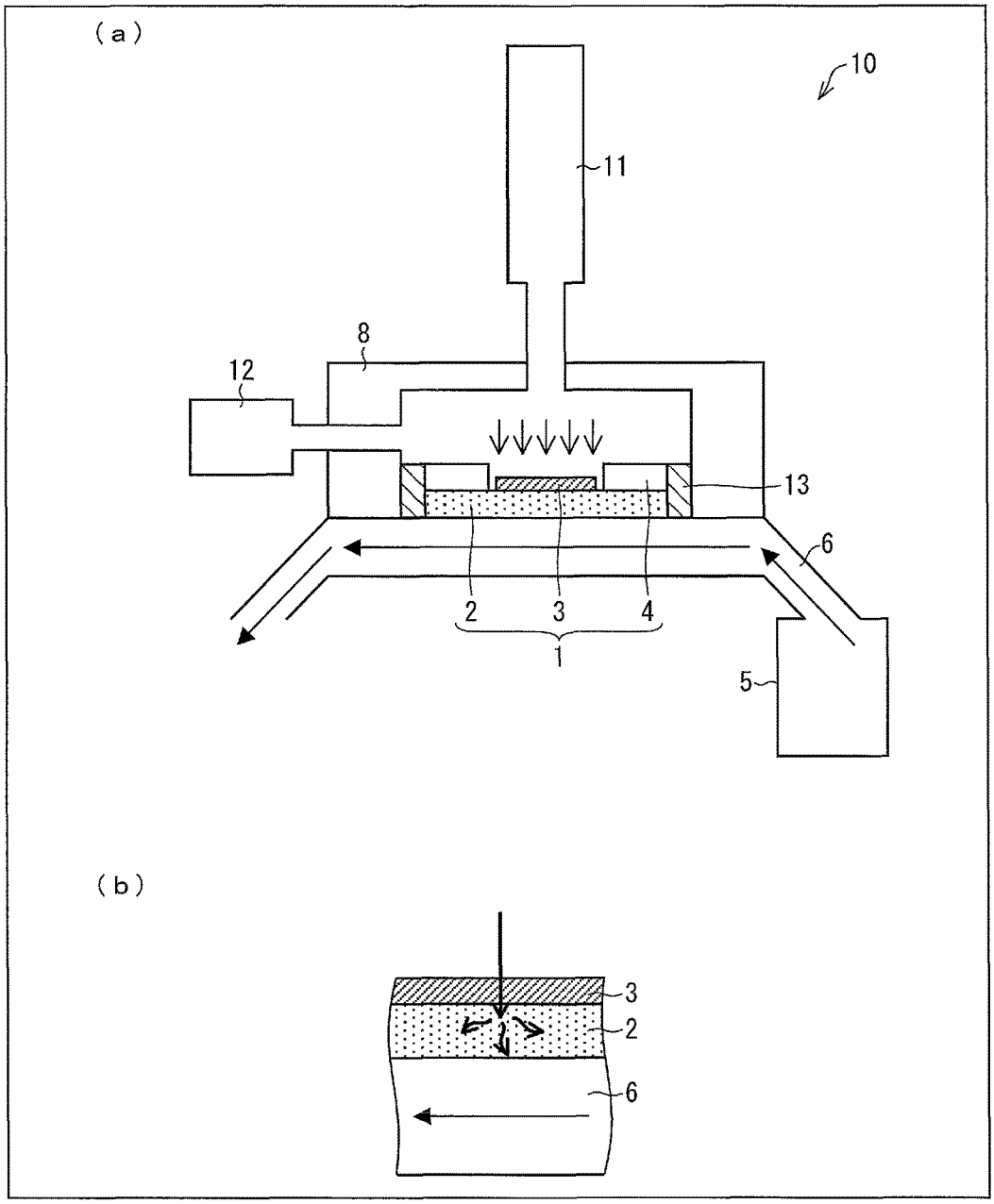

(a) of FIG. 2 illustrates a schematic structure of a neutron generator in accordance with one embodiment of the present invention, and (b) of FIG. 2 illustrates a cross-section of a neutron source and a cooling medium in the neutron generator in accordance with the one embodiment.

Figure 3:
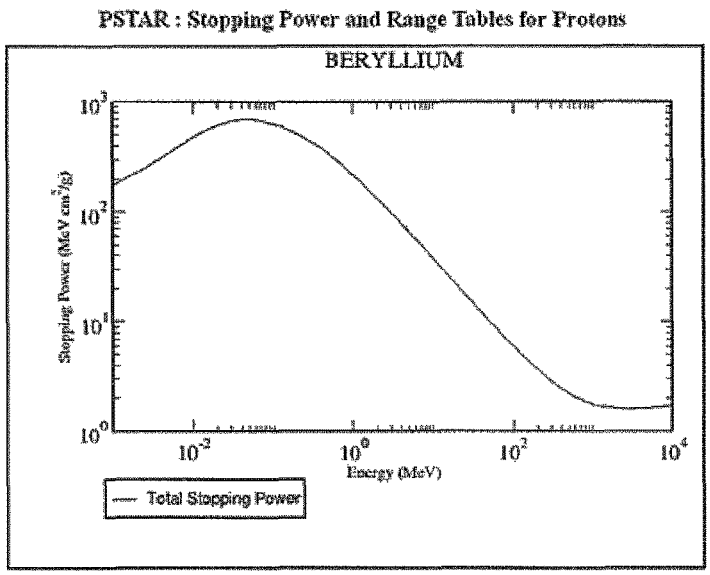
Figure 3:
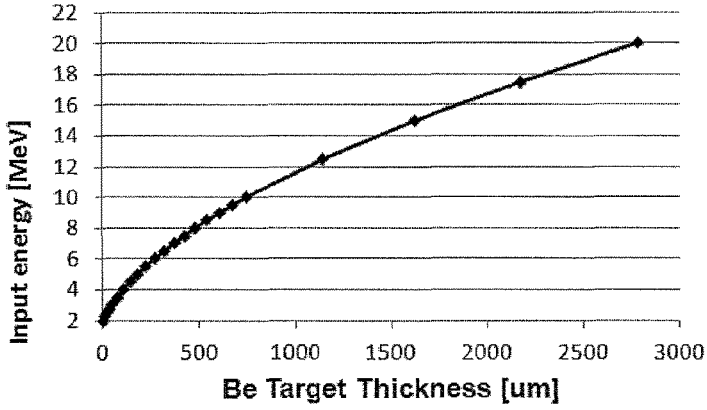

(a) of FIG. 3 shows a result calculated by PSTAR (National Institute of Standard Technology), and (b) of FIG. 3 shows a relationship between energy attenuation and a penetration depth of a proton beam which has been incident on Be.

Figure 4:
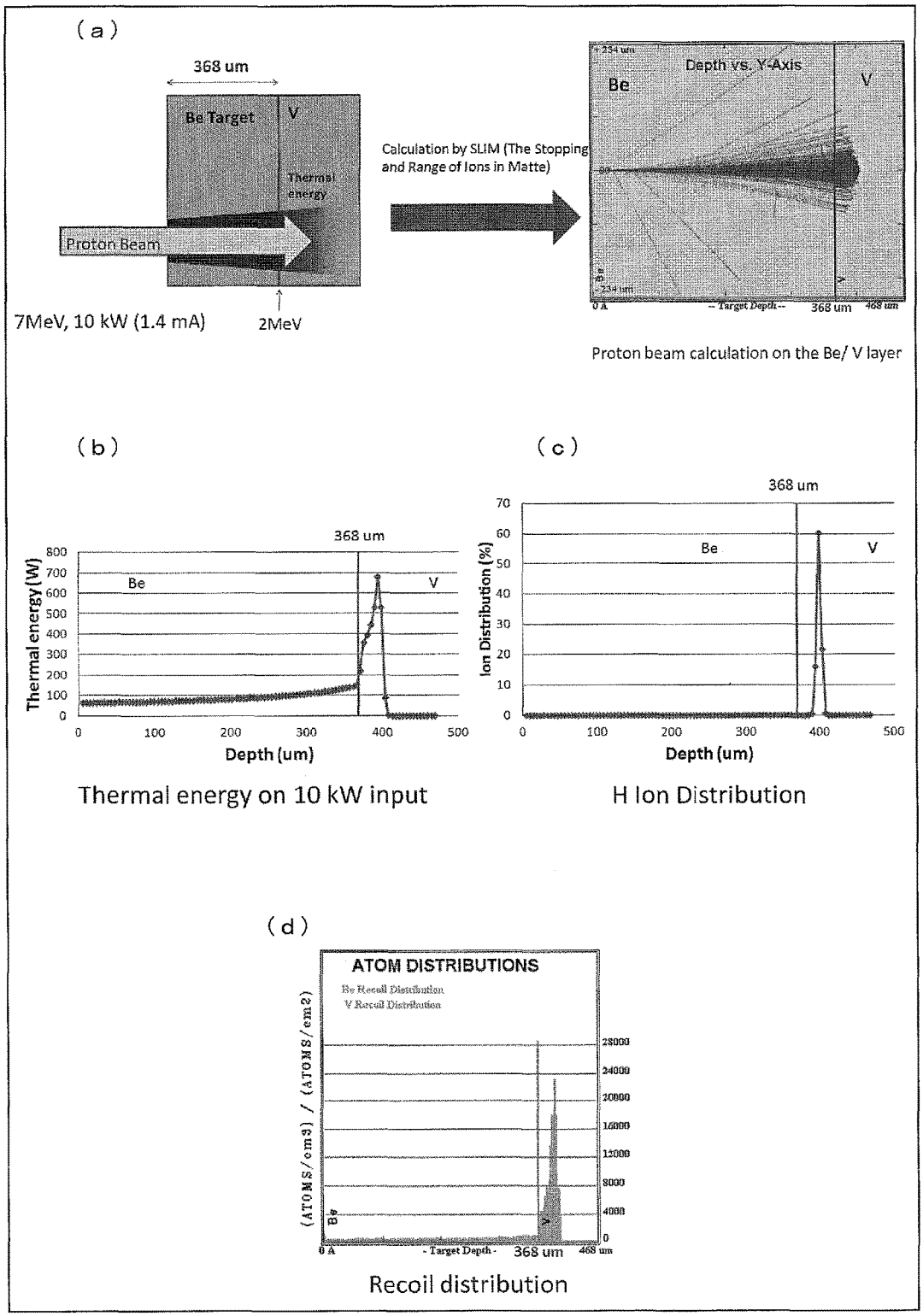

(a) of FIG. 4 illustrates a result of simulation on a depth at which proton beams reaches when Be has a thickness of 365 μm and V has a satisfactory thickness, (b) of FIG. 4 is a graph showing a thermal energy with respect to a distance from a beam incident surface of Be, (c) of FIG. 4 is a graph showing the amount of generated hydrogen ions with respect to the distance from the beam incident surface of Be, and (d) of FIG. 4 shows a distribution of recoil atoms with respect to the distance from the beam incident surface of Be.

Figure 5:
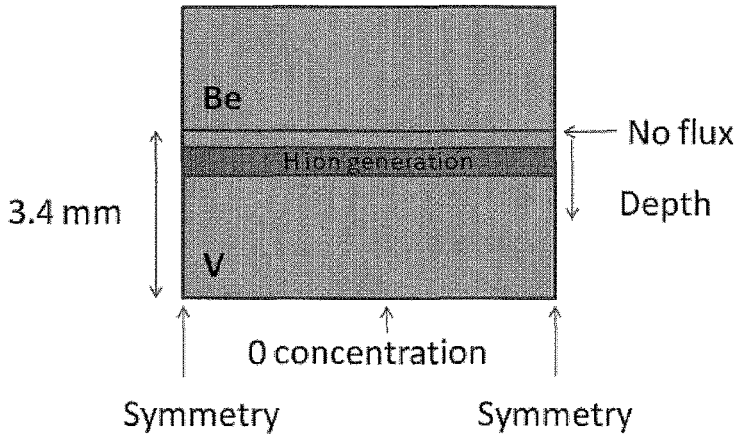
Figure 5:
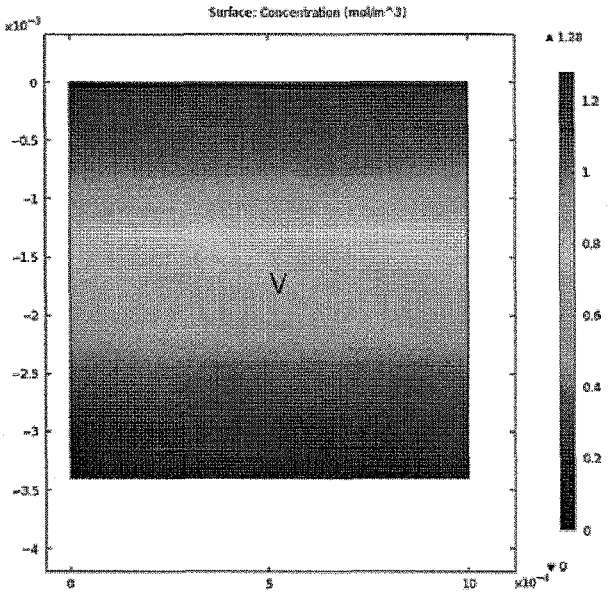

(a) of FIG. 5 schematically illustrates a depth in V at which hydrogen is generated, and (b) of FIG. 5 illustrates a result of simulation on a distribution of a hydrogen concentration in V.

Figure 6:
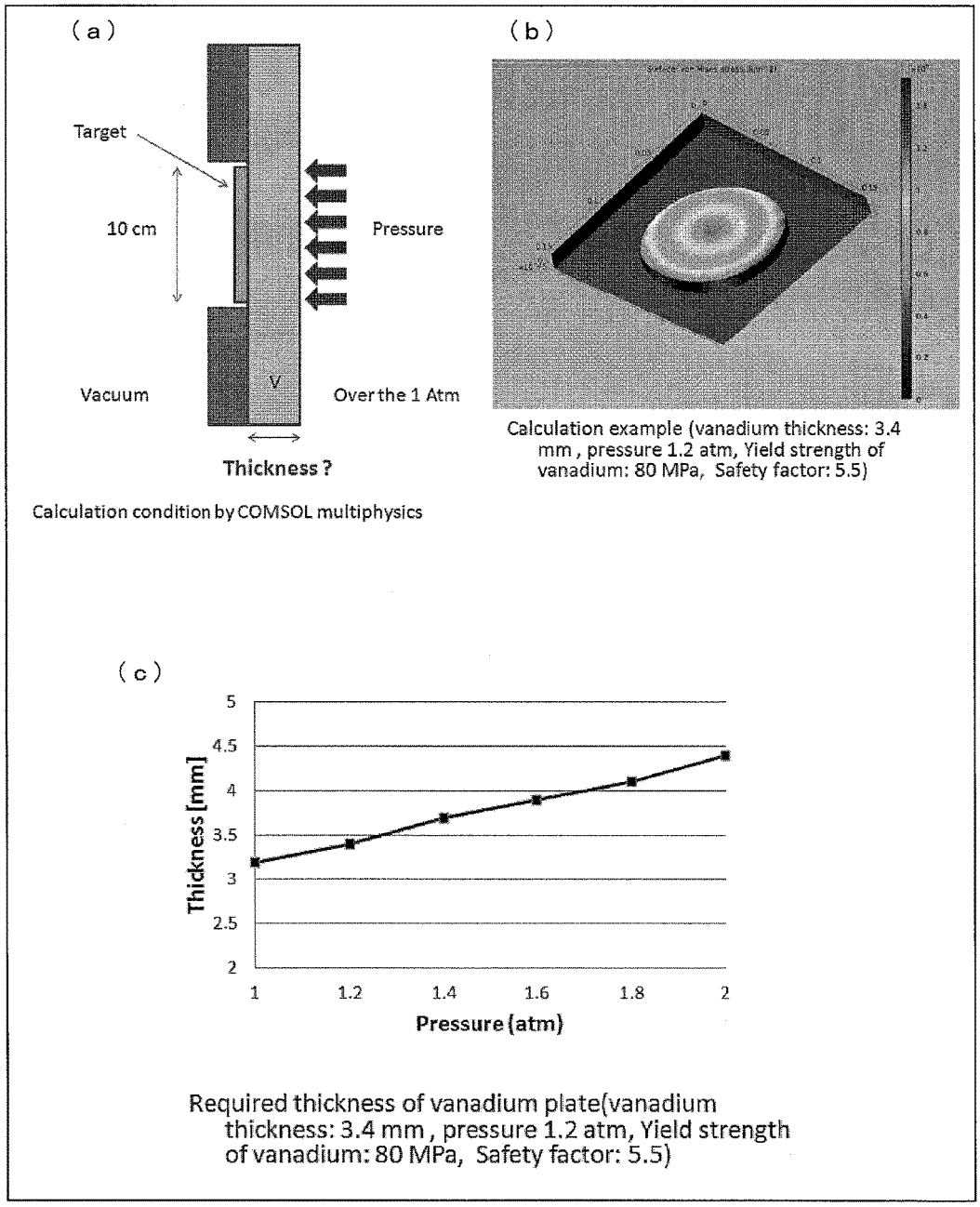

(a) of FIG. 6 schematically illustrates a structure for evaluating a thickness of V which is necessary to obtain a mechanical strength needed for a neutron source, (b) of FIG. 6 illustrates an example where a stress, which was generated when a constant pressure was applied to a neutron source in which a diameter of a target had been set to 100 mm, was calculated by a finite element method, and (c) of FIG. 6 is a graph showing a thickness of V which is necessary to obtain a desired mechanical strength and is based on a calculation result shown in (b) of FIG. 6.

Figure 7:
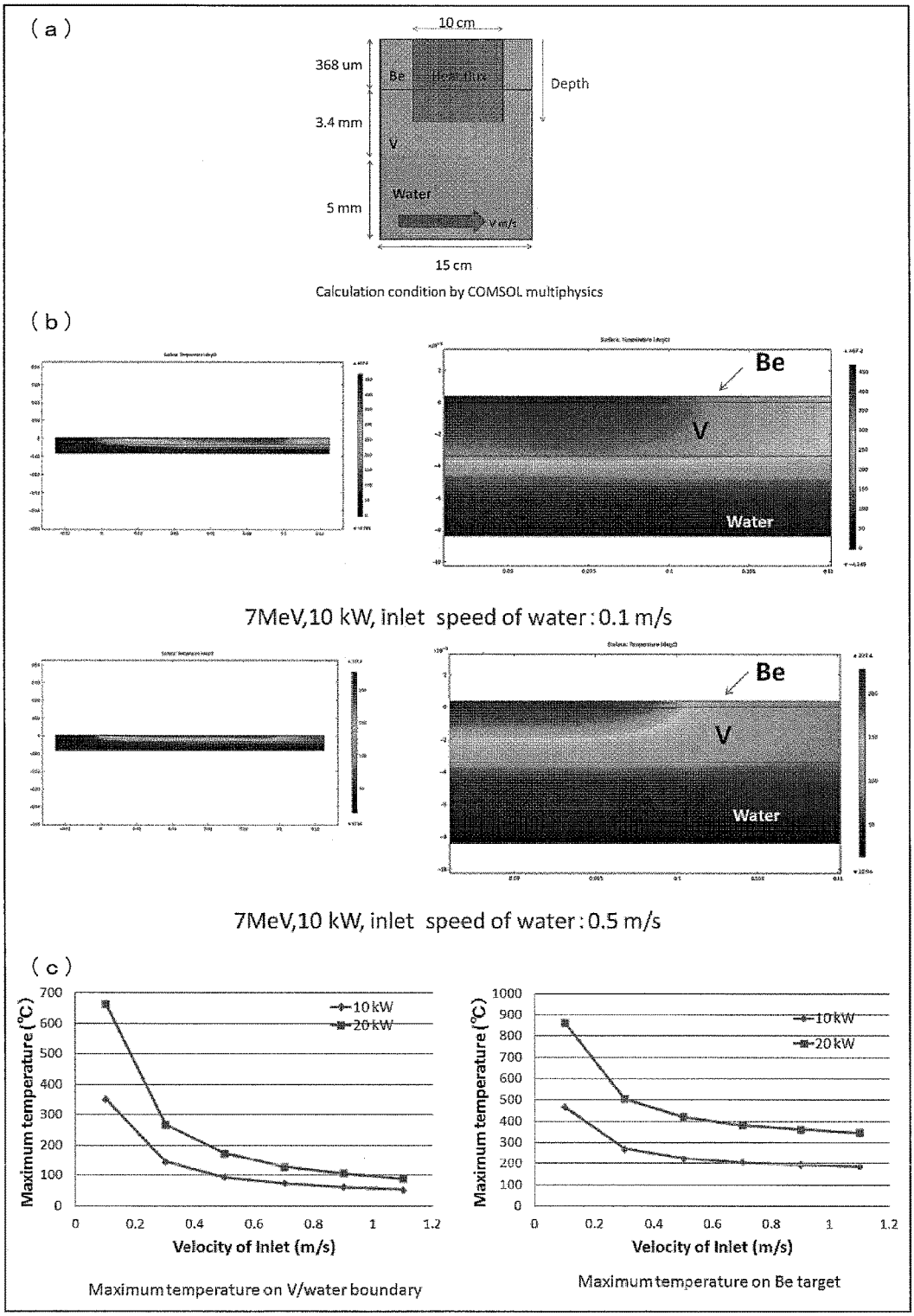

(a) of FIG. 7 schematically shows a condition for evaluating heat release of a neutron generator, (b) of FIG. 7 shows a temperature distribution by 2 dimensional analysis in a case where a flow rate of cooling water is 0.1 m/sec. or 0.5 m/sec., and (c) of FIG. 7 shows graphs showing relationships between the flow rate of the cooling water and (i) a maximum temperature on V/water boundary (left), or (ii) a maximum temperature on Be (right), both of the graphs obtained in a case where proton beams of 10 kW and 20 kW are emitted.

DESCRIPTION OF EMBODIMENTS

[Neutron Source 1]

Figure 1:
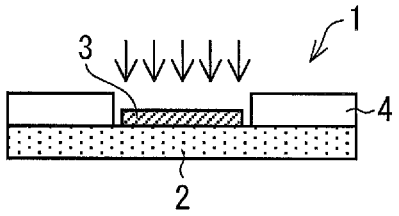
FIG. 1 is a cross-sectional view illustrating a structure of a neutron source in accordance with one embodiment of the present invention.

The following description will discuss a neutron source in accordance with one embodiment of the present invention with reference to FIG. 1. FIG. 1 is a schematic view illustrating an example structure of a neutron source of the present invention. As illustrated in FIG. 1, a neutron source 1 includes a target layer (neutron producing material layer) 3, a support layer (metal layer) 2, and a protection section 4.

The target layer 3 produces neutron beams in response to incident proton beams in the direction of the arrow shown in FIG. 1. By being joined with the target layer 3, the support layer 2 improves heat release of the target layer 3, prevents hydrogen embrittlement, and compensates for a mechanical strength. That is, the neutron source 1 is a neutron source applied to a small neutron generator which can be used in, for example, a small facility. The protection section 4 is a general protection member in such a neutron source. Members of the small neutron source 1 will be further described in detail below.

(Support Layer 2)

The support layer 2 contains at least one metal element as a main content. The metal element has a hydrogen diffusion coefficient of not less than $10^{-11}$ at 60° C., and, upon receipt of neutron beams, generates radionuclides having a half-life of not more than 12 hours. These radionuclides are radionuclides whose total radiation dose is largest among radionuclides generated from the metal element.

That is, the support layer 2 attenuates a maximum concentration of hydrogen or releases the hydrogen to the outside by rapidly diffusing the hydrogen in the inside of the target layer 3 and the support layer 2, which hydrogen has been generated in the layers by incident proton beams, and loses radioactivity in a short time even when receiving neutron beams. Therefore, the support layer 2 prevents hydrogen embrittlement caused by accumulation of hydrogen on the support layer 2 and the target layer 3, and allows long-term usage and long-time continuous operation of the neutron source 1. Further, even if the metal element is converted to radionuclides upon receipt of neutron beams, the support layer 2 loses the radioactivity in a short time, and therefore makes it extremely easy for a human to handle the neutron source 1. The "handling" herein means maintenance etc. of the neutron source 1 by a human. For example, if irradiation of proton beams is stopped for one day to several days at the longest, the radioactivity is reduced to such a degree that a human can touch the neutron source 1. Therefore, regular maintenance can be carried out safely.

From the above, the neutron source 1 in accordance with the present invention is excellent in durability, is widely applicable (operation time is not limited), and is excellent in safety for human bodies. The neutron source 1 is excellent in durability since the neutron source 1 can be prevented from hydrogen embrittlement in particular and regular maintenance of the neutron source 1 is easily carried out.

As described the above, the mechanical strength of the target layer 3 is reinforced by the support layer 2 (e.g., to be durable up to 5 atm), and therefore a thickness and a size of the target layer 3 can be arbitrarily set. Low-energy proton beams penetrate the target layer 3 shallowly. Therefore, by sufficiently reducing the thickness of the target layer 3, the support layer 2 receives proton beams which have been attenuated to less than a threshold of an energy to generate neutrons (e.g., about 2 MeV in a Be (p, n) reaction, about 1.9 MeV in a Li (p, n) reaction) after the target layer 3 was irradiated. In this case, almost all of hydrogen is produced in the support layer 2. Therefore, the hydrogen is diffused in accordance with a value of the hydrogen diffusion coefficient of the support layer 2, and is rapidly discharged to the outside of the neutron source 1. Further, in such a case, because the energy of the proton beams penetrating the target layer 3 is constantly not less than 2 MeV, a generation efficiency of the neutron beams is hardly reduced. In addition, because it is unnecessary to particularly reduce the size of the target layer 3, there is no need to use (large current) proton beams whose irradiation range is narrowed.

As described above, the support layer 2 contains the aforementioned metal element as a main content. The wording "contains as a main content" in the subject specification means that the support layer 2 contains the metal element by moles greater than the half of the total number of moles of molecules constituting the support layer 2. The support layer 2 contains more than 50 mol % of the metal element or contains 60 mol %, 70 mol %, 80 mol %, 90 mol %, or 99 mol % or more of the metal element. The higher the percentage of the metal element that the support layer 2 contains, the better. This is because a generation amount of radionuclides having undesirably long half-lives is reduced.

The metal element may be a metal element contained solely in the support layer 2, or two or more kinds of metal elements contained in combination in the support layer 2. In a case where the metal elements are contained in combination in the support layer 2, a total sum of mol % of the 2 or more kinds of metal elements exceeds 50% in the support layer 2. Further, in a case where the metal elements are contained in combination in the support layer 2, for example, the metal elements may exist as alloy in the support layer 2. The alloy of the metal elements is preferably made from not more than 3 kinds of metal elements. This is because the neutron source 1 can be easily controlled by reducing the kinds of radionuclides to be generated.

In the subject specification, in a case where only one kind of radionuclides is generated upon receipt of neutron beams, the "radionuclides whose total radiation dose is largest" is the one kind of radionuclides, meanwhile, in a case where two or more kinds of radionuclides are generated upon receipt of neutron beams, the "radionuclides whose total radiation dose is largest" is radionuclides having a highest radioactivity among the two or more kinds of radionuclides which are generated, by irradiating neutron beams for a unit time, per gram of elements having a normal isotopic composition.

Therefore, examples of the metal element in accordance with the present invention encompass a metal element which, upon receipt of neutron beams, generates (i) first radionuclides having a half-life exceeding 12 hours, which first radionuclides are 30% of a total generation amount of radionuclides (hereinafter, referred to merely as "total amount"), and (ii) second radionuclides having a half-life not more than 12 hours, which second radionuclides are 70% of the total amount. Meanwhile, the metal element in accordance with the present invention does not encompass a metal element which generates (i) the first radionuclides having the half-life exceeding 12 hours, which first radionuclides are 40% of the total amount, and (ii) the second radionuclides having the half-life of not more than 12 hours, which second radionuclides are 35% of the total amount, and (iii) a third radionuclides having a half-life of not more than 12 hours, which third radionuclides are 25% of the total amount. Note that the above percentages are determined on the basis of dose (Bq) that generated radionuclides have.

The metal element is preferably selected from the group consisting of V, Ni, Ti, and alloys of any combinations of V, Ni, and Ti. Those metal elements have a high hydrogen diffusion coefficient, and mainly generates radionuclides having a short half-life upon receipt of neutron beams. In particular, radionuclides mainly generated from the above metal elements have a short half-life of about 2.5 hours in $^{65}$Ni and of about 3.7 minutes in $^{52}$V, which is extremely short. Therefore, in a case where the support layer 2 which contains the metal elements as a main content is used (in particular, in a case where the metal element is V), for example, the radioactivity is reduced to $10^{-100}$ of an initial value after 24 hours from termination of irradiation of the proton beams. Therefore, handling of the neutron source 1 is extremely easy.

It is preferable that the target layer 3 and the support layer 2 be joined by diffusion bonding or brazing. This joining can surely prevent deformation of the neutron source 1 with use of the mechanical strength of the support layer 2, which deformation could be caused by a pressure applied to the neutron source 1.

(Target Layer 3)

The target layer 3 contains a metal element or a metal compound which produces neutron beams through a low energy nuclear reaction of the metal element or the metal compound with the proton beams. Therefore, the target layer 3 can produce neutron beams by using proton beams having an extremely low energy (e.g., not more than 13 MeV). In a case where the target layer 3 is irradiated with proton beams having more than 13.8 MeV, a generation reaction of tritium occurs. In order to reduce kinds and amounts of radionuclides to be generated, it is preferable to irradiate the target layer 3 with low energy proton beams as described above.

The metal element or the metal compound is preferably selected from the group consisting of Be, Be compounds, Li, and Li compounds. An example of the Be compounds is BeO (beryllium oxide). Examples of the Li compounds encompass LiF (lithium fluoride), $Li_2CO_3$ (lithium carbonate), and $Li_2O$ (lithium oxide). By using such a material, it is possible to produce neutrons with use of extremely low energy proton beams without generating tritium and the like. Therefore, it is possible to satisfactorily reduce the kinds and amounts of radionuclides to be generated, whereby handling of the neutron source 1 is more easily.

The thickness of the target layer 3 is preferably 50 μm to 1.2 mm. In a case where the target layer 3 has the thickness falling within the above range, energy of proton beams penetrating the target layer 3 and arriving the support layer 2 is attenuated to about a neutron generation threshold. In a case where the lower limit value of the range as above is employed, energy of proton beams arriving the support layer 2 is attenuated to about the neutron generation threshold in consideration of attenuation of the energy in wax which is necessary to join the target layer 3 and the support layer 2 by brazing. Meanwhile, in a case where the upper limit value is employed and Be is irradiated with proton beams having an energy of 13 MeV, proton beams arriving a depth of 1.2 mm is attenuated to about the neutron generation threshold.

Therefore, for example, in a case where Be having the above thickness is used, proton beams having an energy within a range of 3.5 MeV to 13 MeV can be practically usable. Therefore, as described above, most of hydrogen can be generated in the support layer 2 without reducing efficiency in producing neutrons. That is, it is possible to prevent hydrogen embrittlement of the target layer 3 while attaining highly efficient neutron production.

A shape of a surface of the target layer 3, which surface is irradiated with proton beams, is not particularly limited. However, the shape is substantially a circle in general in view of irradiation of proton beams. As shown in FIG. 1, the protection section 4 is provided around the target layer 3. The protection section 4 is one generally provided to a neutron source 1 as such. Therefore, detailed description of the protection section 4 is omitted herein. Further, as shown in FIG. 1, a surface opposite to the above surface of the target layer 3 is joined with the support layer 2. Furthermore, a cross-sectional shape of the target layer 3 can be triangle waves in which a plurality of indented parts are continuously provided. With this shape, it is possible to efficiently diffuse a heat of proton beams, and therefore the neutron source 1 in accordance with the present invention is also applicable to proton beams having a larger current.

From the above, the neutron source 1 in accordance with the present invention prevents damages caused by hydrogen embrittlement without reducing a yield of neutrons, shows a satisfactory mechanical strength, and loses the radioactivity in a short time. Therefore, the neutron source 1 in accordance with the present invention meets all requirements for practical uses, such as continuous operation for a long period of time, excellent durability, and easiness of maintenance.

[Neutron Generator]

The following description will discuss a neutron generator in accordance with one embodiment of the present invention with reference to FIG. 2. (a) of FIG. 2 illustrates a schematic structure of a neutron generator in accordance with one embodiment of the present invention. (b) of FIG. 2 illustrates a cross-section of a part of a neutron source and a cooling medium in the neutron generator in accordance with the one embodiment.

As illustrated in (a) of FIG. 2, the neutron generator 10 includes the neutron source 1, a cooling medium supply section 5, a channel 6, a housing 8, a proton beam generation section 11, and a decompression device 12. The neutron source 1 is placed such that the target layer 3 faces an upper surface inside the housing 8 of the neutron generator 10. A proton beam incident opening 7 is formed in the upper surface of the housing 8. The proton beam incident opening 7 is connected to the proton beam generation section 11, and allows the target layer 3 of the neutron source 1 to be irradiated with proton beams. The decompression device 12 is connected with the inside of the housing 8, and a space between the upper surface of the housing 8 and the neutron source 1 is kept under vacuum. The channel 6 connected to the cooling medium supply section 5 is provided to be in contact with the support layer 2 of the neutron source 1.

That is, the neutron generator 10 in accordance with the present invention has the same structure as a general neutron generator except for the neutron source 1 and the channel 6. Therefore, only the neutron source 1 and the channel 6 will be described in detail below. The structure of the neutron source 1 has been described above, and therefore description thereof will not be repeatedly made.

As shown in (a) of FIG. 2, the cooling medium from the cooling medium supply section 5 flows through the channel 6 in a direction indicated by the arrow in (a) of FIG. 2. In a part where the support layer 2 and the channel 6 are in contact with each other, the cooling medium absorbs heat generated in the neutron source 1 to thereby cool the neutron source 1. This state will be further described below.

As shown in (b) of FIG. 2, proton beams emitted to the target layer 3 penetrate the target layer 3 and reach the support layer 2. At this time, hydrogen based on proton is absorbed and diffused by the support layer 2. A surface of the support layer 2, on which surface the target is not formed, is in direct contact with the cooling medium in the channel 6. Therefore, hydrogen is released to the cooling medium from the support layer 2 having a large hydrogen diffusion coefficient. That is, the cooling medium have two functions, cooling the neutron source 1, and removing hydrogen. As such, by cooling the neutron source 1, the cooling medium supply section 5 and the channel 6 in accordance with the present invention not only prevent melting, deformation, breakage, and the like of the neutron source 1 but also further reduce a possibility of hydrogen embrittlement of the neutron source 1. Note that the cooling medium is not particularly limited provided that it can cool the neutron source 1 and examples of the cooling medium encompass water, oil, and liquid metal.

There has been described an example arrangement in which the cooling medium and the support layer 2 are in direct contact with each other. However, the channel 6 may be formed as an independent pipe, and the cooling medium and the support layer 2 may be arranged not to be in direct contact with each other.

The neutron source 1 can be attached to the housing 8 via, for example, a seal member 13 such as an o-ring with elastomer or a metal gasket ((b) of FIG. 2). This prevents penetration of the cooling medium from a boundary between the housing 8 and the neutron source 1 and maintains a degree of vacuum on a beam incident side. By employing such a structure, the neutron source 1 can be easily replaced.

From the above, the neutron generator 10 including the neutron source 1 has excellent durability, is widely applicable (operation time is not limited), and is excellent in safety for human bodies. Therefore, for example, the neutron generator 10 is suitable for application to medical instruments placed in small facilities.

[Summary]

In order to achieve the above object, the neutron source (neutron source 1) of the present invention includes: a neutron producing material layer (target layer 3) for producing neutron beams upon receipt of irradiation of proton beams; and a metal layer (support layer 2) joined with the neutron producing material layer, the metal layer containing, as a main content, such a metal element that has a hydrogen diffusion coefficient of not less than $10^{-11}$ at 60° C., and generates radionuclides upon receipt of the irradiation of the neutron beams, among which radionuclides, a type of radionuclides having a largest total radiation dose has a half-life of not more than 12 hours.

In the neutron source of the present invention, it is preferable that the metal element be selected from the group consisting of V, Ni, and Ti, and alloys of any combinations of V, Ni, and Ti.

In the neutron source of the present invention, it is preferable that the neutron producing material have a thickness of 50 μm to 1.2 mm.

In the neutron source of the present invention, it is preferable that the target be selected from the group consisting of Be, Be compounds, Li, and Li compounds.

In the neutron source of the present invention, it is preferable the target and the support layer be joined by diffusion bonding or brazing.

In order to achieve the object, the neutron generator 10 of the present invention includes the above-mentioned neutron source.

EXAMPLE

The neutron source in accordance with the present invention will be described in detail with a specific example. This example shows, with reference to FIGS. 3 to 7, a result of simulation on various properties of a neutron source made from specified materials.

(Conditions)

A material of a target: Be, a material of a support layer: V, a joining method: diffusion bonding (direct bonding), and an intensity of proton beams to be irradiated: 7 MeV (10 kW).

The following points were examined under the above conditions.

1. Maximization of Neutron Generation Efficiency, 2. Penetration Depth of Proton Beam to Neutron Source and Diffusion of Hydrogen in Neutron Source, 3. Mechanical Strength, 4. Heat Release, 5. Radionuclides Generated for Each Element, Half-Life, and Hydrogen Diffusion Coefficient of Each Material.

(1. Maximization of Neutron Generation Efficiency)

FIG. 3 shows a result of examination of a relationship between a penetration depth and an energy when a Be target was irradiated with proton beams of 7 MeV. As shown in FIG. 3, it can be presumed that the energy of the proton beams is attenuated to 2 MeV, which is a threshold of neutron generation in a Be (p, n) reaction, when the depth becomes about 368 μm. Therefore, it is considered that, by setting the thickness of a Be target to not more than 368 μm, proton beams passing through the Be target contribute to generation of neutrons in an arbitrary depth.

(2. Penetration Depth of Proton Beam to Neutron Source and Diffusion of Hydrogen in Neutron Source)

Based on the result of 1., conditions of the thickness of the Be target=365 μm and the thickness of V=satisfactorily thick were set, and various simulations regarding proton beams (hydrogen) in the neutron source were carried out with use of a simulation code (SRIM, see the web page http://www.srim.org/ by James F. Ziegler). Results of the simulations are shown in FIG. 4.

(a) of FIG. 4 illustrates a result of simulation on a depth at which proton beams reaches when Be has a thickness of 365 μm and V has a satisfactory thickness. (b) of FIG. 4 is a graph showing a thermal energy with respect to a distance from a beam incident surface of Be. (c) of FIG. 4 is a graph showing a generation amount of hydrogen ions with respect to the distance from the beam incident surface of Be. (d) of FIG. 4 shows a distribution of recoil atoms with respect to the distance from the beam incident surface of Be.

As shown in (a) and (d) of FIG. 4, recoil atoms were hardly generated in the Be target and a generation amount of the recoil atoms was small even in the support layer, and therefore it was found that the neutron source of this example was not easily damaged by proton beams. As shown in (c) of FIG. 4, it could be confirmed that most of hydrogen atoms were accumulated in the support layer (V). As shown in (b) of FIG. 4, it was found that almost all of the thermal energy occurred in the support layer (V).

Based on the result of FIG. 4, a concentration of hydrogen generated in the support layer (V) when the support layer (V) was irradiated with proton beams for a long period of time was calculated by a finite element method (COMSOL Multiphysics 4.0, COMSOL, Inc. (Sweden)) based on a diffusion equation. Results of this calculation are shown in FIG. 5. (a) of FIG. 5 schematically illustrates a depth in V where hydrogen is generated. (b) of FIG. 5 illustrates a result of simulation on a distribution of a hydrogen concentration in V.

As shown in (b) of FIG. 5, the concentration of hydrogen atoms is 1.3 mol/$m^3$ at a maximum even in a stationary state, i.e., even if the proton beams are continuously irradiated, which concentration is largely below a limit value (about 30% at a ratio of atomic number density): $3.5\times10^4$ mol/$m^3$ at which hydrogen embrittlement of V is supposed to occur. Therefore, it is considered that, by employing V as a material of the support layer, the hydrogen embrittlement will be avoided.

(3. Mechanical Strength of Neutron Source)

In a case where the neutron source is actually used, a target side on which proton beams are incident is in a vacuum state and a support-layer side is in contact with the cooling medium. Therefore, the neutron source needs to have an enough mechanical strength to prevent deformation caused by a pressure of an atmosphere and cooling water. Therefore, a stress generated when a diameter of the target was set to 100 mm and a certain pressure was applied was evaluated by the finite element method. Results of this evaluation are shown in FIG. 6.

(a) of FIG. 6 schematically illustrates a structure for evaluating a thickness of V which is necessary to obtain a mechanical strength needed for a neutron source. (b) of FIG. 6 illustrates an example where a stress, which was generated when a constant pressure was applied to a neutron source in which a diameter of a target had been set to 100 mm, was calculated by a finite element method (COMSOL Multiphysics 4.0, COMSOL, Inc. (Sweden)) based on structural mechanics. (c) of FIG. 6 is a graph showing a thickness of V which is necessary to obtain a desired mechanical strength and is based on a calculation result shown in (b) of FIG. 6.

As shown in (b) and (c) of FIG. 6, in a case where a safety factor was set to 5.5 and a yield stress of V was 80 MPa, the support layer having the thickness of not less than 3.4 mm could satisfactorily endure a pressure applied from the outside when the pressure of the cooling water was 1.2 atm.

(4. Heat Release)

In order to evaluate heat release, a distribution in a depth direction of a quantity of heat generated by proton beams was calculated with use of an SRIM code. Analysis of the heat release was carried out by applying a result of this calculation as an approximate boundary condition to the finite element method (COMSOL Multiphysics 4.0, COMSOL, Inc. (Sweden)) based on a computational fluid dynamics/heat transfer coupling calculation model. Results of this analysis are shown in FIG. 7.

(a) of FIG. 7 schematically shows a condition for evaluating heat release of a neutron generator, (b) of FIG. 7 shows a temperature distribution by 2 dimensional analysis in a case where a flow rate of a cooling water is 0.1 m/sec. or 0.5 m/sec., and (c) of FIG. 7 shows graphs showing relationships between the flow rate of the cooling water and (i) a maximum temperature on V/water boundary (left), or (ii) a maximum temperature on Be (right), both of the graphs being obtained in a case where proton beams of 10 kW and 20 kW are emitted.

As shown in (b) of FIG. 7, it was found that, in order to maintain the temperature of the cooling water to be less than 100° C. in a case where proton beams of 7 MeV, 10 kW were emitted, the cooling water needed a flow rate of about 0.5 m/sec. As shown in (c) of FIG. 7, a temperature of a Be surface obtained when the flow rate of the cooling water was 0.5 m/sec was about 200° C., which was largely below the melting point of Be (1287° C.). In other words, it was found that, by carrying out cooling with use of water having a flow rate of about 0.5 m/sec., the neutron source was not thermally broken.

(5. Radionuclides Generated for Each Element, Half-Life, and Hydrogen Diffusion Coefficient of Each Material)

A partial list of elements, radionuclides to be generated, and half-lives are shown below.

TABLE 1

| Element | Generated Radionuclides | Half-life |
|---|---|---|
| Ni | $^{65}$Ni | 2.5 hours |
| Nb | $^{94}$Nb | $2 \times 10^4$ years |
| V | $^{52}$V | 3.7 minutes |
| Ti | $^{51}$Ti | 5.76 minutes |
| Pd | $^{109}$Pd, $^{111}$Pd | 13.7 hours, 23.4 minutes |
| Ag | $^{108}$Ag, $^{110}$Ag | 2.3 minutes, 249 days |

As shown in Table 1, among metal elements having relatively high hydrogen diffusion coefficients, metal elements which have generated radionuclides having relatively short half-lives are V, Ti, and Ni. In particular, V and Ti have extremely short half-lives, specifically, 3.7 minutes and 5.76 minutes, respectively, and V and Ti are attenuated to not more than about $10^{-100}$ after 24 hours from generation. Therefore, there is substantially no bad influence on a human when he/she touches V and Ti. Accordingly, in the above example, only V has been exemplified as a material of the support layer, however, it is considered that the support layer made from only Ti or Ni, and the support layer made from an alloy of an arbitrary combination of V, Ti, and Ni are also suitable for the neutron source of the present invention.

It is known that V shows a hydrogen diffusion coefficient of $7\times10^{-9}$ ($m^2$/sec.) at 60° C. It is known that an alloy of 85% of V and 15% of Ni shows a hydrogen diffusion coefficient of $2\times10^{-11}$ ($m^2$/sec.) at 60° C. Therefore, a metal element or an alloy showing such a high hydrogen diffusion coefficient is suitable as a material for forming the support layer of the present invention therefrom.

From the above results, the neutron source in accordance with the present invention which has been made in accordance with the above design attains to maintain generation of neutrons with a high efficiency, to prevent breakage caused by hydrogen embrittlement, to achieve a high mechanical strength, and to rapidly eliminate the radioactivity. In other words, the neutron source of the present invention is highly safe, excellently durable, widely applicable, and highly convenient.

Note that various simulations and calculations about specified kinds of beams, beams having a specified strength, and specified target materials were carried out in the above description. However, those simulations and calculations are applicable when any of the following conditions are changed. Such changeable conditions are, for example, using other quantum beams (e.g., deuteron), changing beam energy within a range of about 2.5 MeV to 13 MeV, or employing another target material. Further, although the amount of generated radionuclides becomes increased, beam energy over 13 MeV can also be employed.

The present invention is not limited to the description of the embodiments and examples above, and can be modified in numerous ways by a skilled person as long as such modification falls within the scope of the claims. An embodiment derived from a proper combination of technical means disclosed in different embodiments and examples is also encompassed in the technical scope of the present invention.

INDUSTRIAL APPLICABILITY

The present invention is applicable to small neutron generator in which low energy proton beams are used.

REFERENCE SIGNS LIST

1 neutron source (neutron source)
2 support layer (metal layer)
3 target layer (neutron producing material layer)
4 protection section
5 cooling medium supply section
6 channel
7 proton beam incident opening
8 housing
10 neutron generator
11 proton beam generation section
12 decompression device
13 seal member

The invention claimed is:

1. A neutron source, comprising:

a neutron producing material layer for producing neutron beams upon receipt of irradiation by proton beams or deuteron beams, wherein the neutron producing material is solid; and a metal layer joined with the neutron producing material layer, the metal layer containing a metal element that has a hydrogen diffusion coefficient of not less than $10^{-11}$ ($m^2$/sec.) at 60° C. and generates radionuclides upon receipt of the irradiation of the neutron beams, said radionuclides having a largest total radiation dose having a half-life of not more than 12 hours, wherein the metal element is selected from the group consisting of V; an alloy of V and Ni; an alloy of V and Ti; an alloy of Ti and Ni; and an alloy of V, Ni, and Ti, the neutron producing material layer containing a neutron producing material which is selected from the group consisting of Be, a Be compound, Li, and a Li compound.

2. The neutron source as set forth in claim 1, wherein the neutron producing material layer has a thickness of 50 μm to 1.2 mm.

3. The neutron source as set forth in claim 1, wherein the neutron producing material layer and the metal layer are joined by diffusion bonding or brazing.

4. A neutron generator, comprising a neutron source recited in claim 1, wherein the neutron generator comprises a proton beam generation section or a deuteron beam generation section.

5. The neutron source as set forth in claim 1, wherein the neutron producing material layer contains a neutron producing material which is selected from the group consisting of Be and a Be compound.

6. The neutron generator as set forth in claim 5, wherein the proton beams or deuteron beams have an energy within a range of 2.5 MeV to 13.8 MeV.

* * * * *